US005436642A

United States Patent [19]

Oyamaguchi et al.

[11] Patent Number: 5,436,642

[45] Date of Patent: * Jul. 25, 1995

[54] RECORDING PROCESS FOR FORMING IMAGING ON NOVEL RECORDING MEDIUM

[75] Inventors: Akira Oyamaguchi; Yasuo Katano; Hidenori Tomono, all of Yokohama, Japan

[73] Assignee: Ricoh Company, Ltd., Tokyo, Japan

[ * ] Notice: The portion of the term of this patent subsequent to Jan. 11, 2011 has been disclaimed.

[21] Appl. No.: 853,203

[22] Filed: Mar. 18, 1992

[30] Foreign Application Priority Data

Mar. 18, 1991 [JP] Japan ..... 3-078585

[51] Int. Cl.[6] ..... B41M 5/28

[52] U.S. Cl. ..... 347/221; 347/101; 347/171; 346/135.1

[58] Field of Search ..... 346/1.1, 76 R, 140 R, 346/151, 76 PH; 347/101

[56] References Cited

U.S. PATENT DOCUMENTS 3,903,393 9/1975 Stapleton et al. ..... 346/76 R X
5,175,568 12/1992 Oyamaguchi et al. ..... 346/151
5,177,506 1/1993 Katano ..... 346/151
5,200,762 4/1993 Katano et al. ..... 346/76 R
5,335,001 8/1994 Katano ..... 346/76 R

FOREIGN PATENT DOCUMENTS 59-178267 10/1984 Japan ..... B41J 3/20
62-255162 11/1987 Japan ..... B41J 3/20

*Primary Examiner*—Benjamin R. Fuller
*Assistant Examiner*—Alrick Bobb
*Attorney, Agent, or Firm*—Oblon, Spivak, McClelland, Maier & Neustadt

[57] ABSTRACT

A process for forming a dot image on a recording medium, a surface of the recording medium having a characteristic in which a receding contact angle decreases when the recording medium is heated under a condition in which a liquid is in contact with the surface of the recording medium. The process includes the steps of forming a latent image having a plurality of dots, and developing the latent image by a liquid recording agent relative to which the recording medium is moved in a moving direction, wherein each of the dots making the latent image has a triangular shape becoming narrower in a direction opposite to the moving direction. The above step of forming the latent image includes the steps of bring a liquid into contact with the surface of the recording medium, and selectively heating an area on the surface of the recording medium, the area corresponding to each of dots making the latent image, so that the area having the receding contact angle whose value corresponds to a temperature of the heated area becomes each of dots making the latent image.

2 Claims, 13 Drawing Sheets (a)
S
31a
3a
d1
(b)
S
31a
3a
(c)
S
31a
3a
(d)
3a'
31a
3a

RECORDING PROCESS FOR FORMING IMAGING ON NOVEL RECORDING MEDIUM

BACKGROUND OF THE INVENTION

1. Field of the Invention

The present invention generally relates to a process for forming an image on a novel recording medium, and more particularly to a process for forming an image on a novel recording medium, the recording medium having a characteristic in which a receding contact angle decreases when the medium is heated in a condition where the medium is in contact with a contact material such as a liquid.

2. Description of Related Art

An offset printing method using a printing plates is a typical one of methods in which a recording medium is divided into areas where it is easy for liquid to adhere thereto and area where it is hard for the liquid to adhere thereto. However, in this offset printing method, it is difficult to incorporate a process for manufacturing printing plates from original plates and a process for printing from the printing plates into a single apparatus. This makes it difficult to have a compact printing apparatus.

For example, even in a case of relatively compact offset printing apparatus, a plate making apparatus and a printing apparatus are separated.

To eliminate this fault of the offset printing method, there has been proposed a recording method and apparatus in which areas where it is easy for the liquid to adhere thereto and areas where it is hard for the liquid to adhere thereto can be formed in accordance with image information and in which the recording medium can be repeatedly used ( a process for forming an image is reversible). The following are some of these.

① Water-soluble developing method

After a charge has been applied from an external device to a hydrophobic photo-electric layer, a medium having the hydrophobic photo-electric layer is exposed so that a pattern having hydrophobic portions and hydrophilic portions is formed on the surface of the hydrophobic photo-electric layer. Then, a water soluble developing solution adheres to only the hydrophilic portions and is transferred to a paper or the like. Such methods and apparatus are disclosed in Japanese Patent Publication Nos.40-18992, 40-18993 and 44-9512 and Japanese Patent Laid Open Publication No.63-264392, etc.).

② Method using a photo-chemical response of a photo-chromic material

In this method, ultraviolet light is irradiated to a layer which contains a material such as a spiropyran or an azo dye so that a photo-chemical reaction occurs to make the photo-chromic material hydrophilic. Such method and apparatus are described in "Japanese Journal of Polymer Science and Technology" Vol.37, No.4 page 287, 1980).

③ Method using an action of an internal biasing forces

In this method, amorphous substances and crystalline substances are formed in a recording medium by a physical transformation, so that portions where it is easy for a liquid ink to adhere thereto and portions where it is hard for the liquid ink to adhere thereto are formed on the recording medium. An example of such is disclosed in Japanese Patent Laid Open Publication No.54-41902.

According to the previously described method ①, after the water-soluble ink is transferred to the paper or the like, the hydrophilic portions are removed by removing the charge so that it is possible to record other image information. That is, one original plate (photoelectric member) can be repeatedly used for printing images. However, in this method, an electrophotographic process is basically used, so that a long time is required for carrying out the process involving steps of charging, exposing, developing, transferring and discharging. Therefore, it is difficult to make an apparatus compact, to reduce its cost and to make an apparatus in which it is unnecessary to maintain.

In the method ② described above, it is possible to freely control the reversibility of the hydrophilic and hydrophobic properties by selective irradiation of ultraviolet and visible light. However, since a quantum efficiency is very small, the response time is extremely long and a recording speed is low. In addition, there is also a fault of image instability. Therefore, this method has still not put into practical use.

Furthermore, an information recording member (the recording medium) which is used in the method ③ has stability after an image is formed thereon, but there are occasional structural transformations which occur in the information recording member because of temperature changes prior,to the recording. That is, the method ③ has a disadvantage in that it is difficult to maintain the image on the information recording member. In addition, when recorded information patterns are removed, a thermal pulse must be applied to the information recording member and then it is necessary to rapidly cool the information recording member. Therefore, it is difficult to perform frequent repetition of image formation.

In addition, to obtain a clear dot image, it is desired that dots in the dot image be accurately separated from each other.

SUMMARY OF THE PRESENT INVENTION

Accordingly, a general object of the present invention is to provide a novel and useful process for forming an image on a recording medium in which the disadvantages of the aforementioned prior art are eliminated.

A more specific object of the present invention is to provide a process for forming an image a recording medium in which a predetermined pattern area can be selectively or selectively and reversibly formed on the surface of the recording medium.

Another object of the present invention is to provide a process and an apparatus for forming an image on a recording medium in which an image transferred from the recording medium to the recording sheet can be maintained in high quality for a long time even when an environment of the image formed on the recording sheet varies.

Furthermore object of the present invention is to provide a process for forming an image on a recording medium in which dots in a dot image can be accurately separated from each other.

The above objects of the present invention are achieved by a process for forming a dot image on a recording medium, a surface of the recording medium having the characteristic in which a receding contact angle decreases when the recording medium is heated under a condition in which a liquid is in contact with the surface of the recording medium, the process comprising the steps of: (a) forming a latent image having a plurality of dots, the step (a) comprising the steps of:

(a-1) bringing a contact material into contact with the surface of the recording medium, the contact material being selected from a liquid, vapor and a solid which generates or changes to either vapor or a liquid under a condition of a temperature lower than a temperature at which the receding contact angle of the surface of the recording medium starts to decrease; and (a-2) selectively heating an area on the surface of the recording medium, the area corresponding to each of dots making the latent image, so that the area having the receding contact angle whose value corresponds to a temperature of the area heated by the step (a-2) becomes each of dots making the latent image; and (b) developing the latent image obtained in the step (a) by a liquid recording agent relative to which the recording medium is moved in a moving direction, wherein each of the dots making the latent image obtained in the step (a) has a shape becoming narrower in a direction opposite to the moving direction in a part close to an end of each of the dots.

According to the present invention, the recording medium having a characteristic, in which the receding contact angle is decreased when the recording medium is heated under a condition where the liquid is in contact with the recording medium, is used to form an image. Thus, an area on which the receding contact angle is decreased can be easily selectively formed on the recording medium. In a state where the area is formed, when the recording medium is heated without liquid, the receding contact angle on the area is returned to the original value. That is, the area disappears from the recording medium.

In addition, each of the dots making the latent image has a shape becoming narrower in a direction opposite to the moving direction in which the recording medium is moved relative to the liquid recording agent. Thus, dollops of liquid recording agent adhering to adjacent dots of the latent image are hardly connected to each other.

Additional objects, features and advantages of the present invention will become apparent from the following detailed description when read in conjunction with the accompanying drawings.

DETAILED DESCRIPTION OF THE INVENTION

Figure 1A:
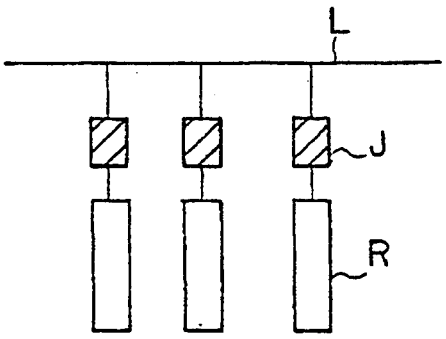
FIGS. 1A through 1D are views indicating models of the structure of a material having a surface self-orientation function.

The inventors of the present invention carried out much research and investigation regarding a novel recording method in which the faults described for the conventional technologies had been eliminated. As a result of this, the inventors discovered that a member having the following characteristics is effective as a recording medium.

When an area on the surface of the member is heated in a condition of being in contact with the liquid and then cooled, a receding contact angle of the area becomes smaller. After that, when the area is heated in a condition in which the liquid has been removed, the receding contact angle of the area becomes larger and returns to an original value. The receding contact angle of the area can be controlled in accordance with a temperature of the heated area.

One of the members having the above characteristic is a first member (1) in which the surface portion thereof includes an organic compound having a surface self orientation function with a hydrophobic group, or a second member (2) in which the surface portion thereof is an organic compound having the hydrophobic group which is oriented to the surface (pending U.S. patent application No. 620,579) U.S. Pat. No. 5,278,126.

The "surface self orientation function" in the first member (1) is defined as a function whereby the hydrophobic group at the surface is oriented towards the side of the air (i.e. the side with the free surface) when a solid comprising a base member and an organic compound formed on the base member or a solid organic compound is heated in the air. This definition is also used for the second member (2). In general, an organic compound offers a phenomena in which a hydrophobic group is easily oriented towards the side of a hydrophobic atmosphere. As the orientation is towards the side at which the interfacial energy of the solid-gas boundary decreases, the above phenomena occurs. In addition, this phenomena is remarkable for the longer the molecular chains of the hydrophobic group, because the larger the molecular chain the mobility of the molecule becomes larger.

More specifically, in a case of a molecule which has a hydrophobic group at an end thereof (i.e. a molecule in which the surface energy is low), the hydrophobic group is easily oriented in a direction of the side of the air (i.e. the side with the free surface). In the same manner, in a case of chain molecules which include $-(CH_2)_n-$, $-(CH_2CH_2)-$ portions are flat and easily oriented. In addition, in molecules which include $(-Ph-)_n$, $-Ph-$ portions also have a flat structure and are easily oriented. Ph represents phenylene group. Especially, the chain molecules including a chemical element in which an electronegativity is large, such as a fluoride, have a large self aggregation. In the chain molecules, mutual molecular chains are easily oriented.

To summarize the results of these investigations, in a chain molecule which includes a molecule having a large self aggregation or a molecule having a flat structure and has the hydrophobic group at an end thereof, or in an organic compound including the above chain molecule, the surface self orientation function is large.

As is clear from the preceding discussion, there is a relationship between the surface self orientation and the receding contact angle. In addition, there is also a relationship between the receding contact angle and the liquid adhesiveness. That is, the adhesion of the liquid to the surface of the solid mainly occurs due to a tacking force for tacking the liquid at the surface of the solid. The tacking force can be regarded as a type of friction which is generated when the liquid slides against the surface of the solid. Thus, in this invention, the "receding contact angle" $\theta_r$ can be denoted by the following formula.

$$\cos\theta_r=\gamma(\gamma_s-\gamma_{se}-\pi_e+\gamma_f)/\gamma_{ev}$$

where:

$\gamma$: surface tension of a solid in a vacuum $\gamma_{se}$: surface tension at the solid-liquid interface $\gamma_{ev}$: surface tension of the liquid in a condition in which the liquid is in contact with a saturated vapor $\pi_e$: equilibrium surface tension $\gamma_f$: friction force $\gamma_s$: surface tension of a solid without an absorption layer The above formula is disclosed by Saito, Kitazaki et al, "Japan Contact Adhesive Association Magazine" Vol.22, No.12, No.1986.

According to the above formula, when the receding contact angle $\theta_r$ decrease, the friction force $\gamma_f$ increases. That is, when the receding contact angle increases, it becomes hard for the liquid to slip on the surface of the solid. As a result, the liquid is adhered to the surface of the solid.

As can be assumed from the above mutual on the receding contact angle $\theta_r$. This receding relationships, the adhesiveness of the liquid depends contact angle $\theta_r$ depends on types of materials which have the surface self orientation function at the surface thereof. Hence, in the present invention, it is necessary to form a predetermined pattern area on the recording medium (A) and/or to make a visible image corresponding to the pattern area by a recording agent (solid ink), so that a member in which the surface thereof has the surface self orientation function is selected as the recording medium (A).

The recording medium (A) used in the present invention has a surface in which the receding contact angle $\theta_r$ decreases when the surface is in contact with the liquid in a condition of heating it.

The recording medium (A) can be of any shapes as long as the surface thereof has the nature described above. Thus, the recording medium (A) can be of a film shape or a belt shape (e.g. an endless belt). The recording medium (A) can also have a structure in which a coating film or the like having the nature described above is provided on the surface of a supporting member (a cylindrical member). The recording medium (A) can be structured by only one member in which the surface thereof has the nature described above.

An area where it is easy for the liquid to adhere thereto, which area is formed on the recording medium (A), becomes either a lipophilic area or a hydrophilic area in accordance with the type of contact material (B). Thus, either oil-soluble ink, water-soluble ink or liquid developer for an electrophotography is used for printing an image.

FIGS. 1A through 1D indicate a classification of the types of materials or portions of materials "having a surface for which the receding contact angle $\theta_r$ decreases when the material is heated and brought into contact with a liquid". FIG. 1A indicates an example of a compound having a self-orientation function. This compound has a hydrophobic group on the side chains of the macromolecule polymer. The main chain L and the hydrophobic group R are linked by a linking group J.

Figure 1B:
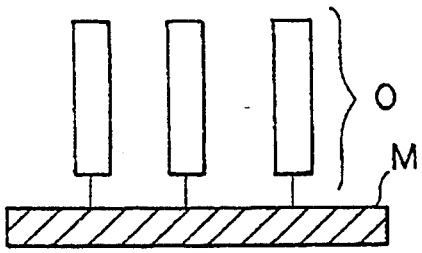
Figure 1C:
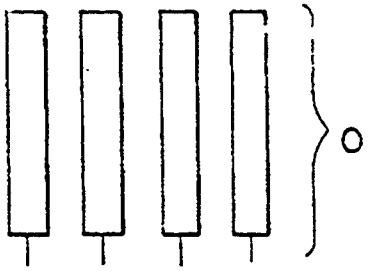

FIG. 1B indicates an example of a material in which the hydrophobic group in an organic compound are oriented towards the surface thereof. The compound 0 having the previously described hydrophobic group is formed by the physical or chemical linking to the surface of an organic or inorganic material M. FIG. 1C shows an example of a material which is made up of only the organic compound O having the hydrophobic group indicated in FIG. 1B.

Figure 1D:
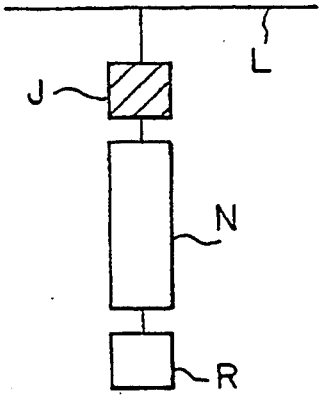

FIG. 1D indicates an example where the chain molecules are in a side chain of a macromolecule. The chain molecules and the main chain L are linked by the linking chain J. This is a compound in which each chain molecule has a molecular chain N having either a flat structure of a self-aggregation and the hydrophobic group R is linked at an end of the molecular chain N.

In the examples shown in FIGS. 1A and 1D, the main chain L of the macromolecule compound can either have a linear shape or a network structure.

In the example indicated in FIG. 1B, as in a case of a deposited Langmuir-Blodgett film, it is also possible to use a compound O including a hydrophobic group and then deposit a compound O including a hydrophobic group on another one. In the example indicated in FIG. 1C, there is only a compound including a hydrophobic group, with there being no main chain L and no linking to an organic or inorganic material (M) or the like.

The previously described hydrophobic group should desirably have the end molecules as $-CH_3$, $-CF_3$, $-CF_2H$, $-CFH_2$, $-C(CF_3)_3$, $-C(CH_3)_3$ or the like. More desirably however, it is advantageous if this hydrophobic group has long molecules which have a high molecular mobility. Of these, the previously described hydrophobic group can be an alkyl group in which either a fluorine or a chlorine is substituted for at least one hydrogen thereof, which alkyl group has more than one -F and/or -Cl, such as $$-CF_2CF_2\underset{\underset{Cl}{|}}{C}FCF_2CF_2.$$

The above hydrophobic group can also be an alkyl group having a carbon number equal to or greater than 4. An alkyl group in which either a fluorine (F) or a chlorine (Cl) substituted for at least one hydrogen thereof can be used and it is more effective if an alkyl group in which a fluorine is substituted for at least one hydrogen thereof is used. It is further more effective that a compound has the polymer whose side chain includes fluorine.

The principle of this function is not yet perfectly understood but is assumed to be as described below.

First, it will be considered that the surface of a recording medium (A) formed by this compound described above has a surface on which the hydrophobic group is considerably oriented. Thus, this surface has a liquid repellency property (since the surface energy of the hydrophobic group is the smaller). In this state, when the surface of the recording medium (A) and the contact material (B) are brought into contact and heated, the heating causes the molecular motion of the hydrophobic group to increase and the recording medium (A) and the contact material (B) are interacted with each other. Thus, an orientation state of at least one portion of the recording medium (A) changes into another one (for example, the orientation is disordered). Then the changed state is maintained after the recording medium (A) is cooled. Even if the contact material (B) is either a vapor or a solid before heating, the contact material (B) in contact with the recording medium (A) becomes liquid in the state in which the recording medium (A) is being heated.

Prior to heating, because the hydrophobic group is oriented in the surface of the recording medium (A), the surface energy of the recording medium (A) is extremely low. However, by heating the recording medium (A) in the state where the contact material (B) is in contact therewith, the orientation is disordered and the surface energy increases. The receding contact angle $\theta_r$ is determined by the balance between the surface energy of the solid and surface energy of the liquid. If the surface energy of the solid is high, then irrespective of the type of liquid, the receding contact angle $\theta_r$ will become smaller. Thus, the adhesiveness with respect to the liquid will increase as a result.

Furthermore, after the orientation state in the surface of the recording medium (A) changes into another orientation state or a state in which the orientation is disordered, when the recording medium (A) is heated in a condition where there is no contact material (B), the interaction between the recording medium (A) and the contact material (B) does not occur, so that the recording medium (A) reverses to the former orientation state.

Accordingly, the contact material (B) is not one where it simply performs cooling after the surface of the recording medium (A) has been heated, but is one where there is some kind of the recording medium (A) for the change of state (either a state where there is an orientation different from the former orientation state or a state where the orientation has been disordered) to occur.

As has been described above, when the hydrophobic group of a member (compound) forming the surface of the recording medium (A) is an alkyl, an alkyl group in which either a fluorine or a chlorine is substituted for at least one hydrogen thereof, then it is necessary for the carbon number of the alkyl to be 4 or more. This carbon number equal to or greater than 4 is thought to be the necessary number for active molecule motion when heating is performed, and for a certain degree of orientation of the alkyl on the surface of the recording medium (A). In addition, when the contact material (B) is heated along with the surface of the recording medium (A), it is thought that the molecules of the contact material (B) are incorporated into the molecules of the surface of the recording medium (A). Furthermore, an alkyl group including fluorine or chlorine which has a high electronegativity is used, then there is a large interaction with liquid and particularly liquids having polarity and so there is a larger change in the adhesiveness than in the case of a compound that includes an alkyl group in which there are not fluorine and chlorine. In addition, the alkyl group which includes fluorine has a strong self-aggregation and so the surface self-orientation function is also high. Still furthermore, the alkyl group which includes fluorine has a low surface energy and so have an excellent effect in prevention the surface of the recording medium (A) from being dirtied.

Moreover, the surface of the recording medium (A) has a liquid repellency effect. This may be described in terms of the surface energy of a solid. In the course of the investigation performed by the inventors, it was found that it is desirable as far as use for a recording method is concerned, for this surface energy to be 50 dyn/cm or less. When the surface energy of the recording medium (A) is greater than 50 dyn/cm, the surface of the recording medium is easily wet and it is possible to become dirty with the recording agent.

A detailed description will now be given of a compound forming the surface of the recording medium (A).

A compound in which an alkyl group (which can include fluorine and/or chlorine) is included in the side chain of a polymer can be preferred as the type of compound as shown in FIG. 1A or 1D. More specifically, monomers indicated in (I), (II), (III),

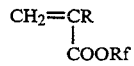
(I)

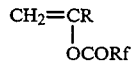
(II)

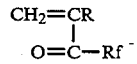
(III)

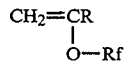
(IV)

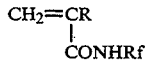
(V)

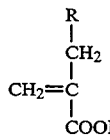
(VI)

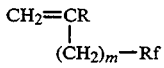
(VII)

R is either —H, $—CH_3$, $—C_2H_5$, $—CF_3$ or $—C_2F_5$.

Rf is either an alkyl group having a carbon number equal to or greater than 4, a group including an alkyl group in which either a fluorine or a chlorine is substituted for at least one hydrogen thereof, or a hydrophobic group in which $-(CF_2)_i-$, $-(CH_2)_i$ or —Ph— (where $i \geqq 4$)

m is an integer and equal to or greater than 1.

Other polymers are those indicated in (VIII), (IX) and (X).

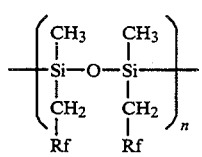
(VIII)

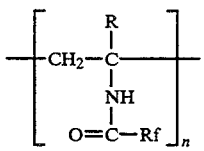
(IX)

-continued (X)

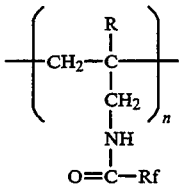

R is either —H —$CH_3$, —$C_2H_5$, —$CF_3$ or —$C_2O_5$.

Rf is either an alkyl group having a carbon number equal to or greater than 4, a group including an alkyl group in which either a fluorine or a chlorine is substituted for at least one hydrogen thereof, or a hydrophobic group in which $-(CF_2)_i-$, $-(CH_2)_i-$ or —Ph— is provided in the molecule chain (where $i \geqq 4$).

n is an integer and equal to or greater than 10.

In these (I) through, Rf can be as indicated in to the following (1) through (20).

$-CH_2CF_2CHFCF_3$ (1)

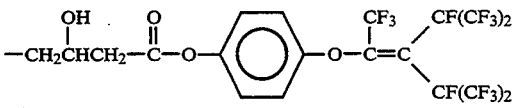

(2)

$-CH_2CH_2OC(=O)-C_7F_{25}$ (3)

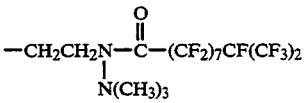

(4)

$-CH_2CH(OH)CH_2(CF_2)_4CF_3$ (5)

$-CH_2(CF_2)_{10}H$ (6)

$-(CF_2)_6O-CF_2CF_3$ (7)

$-(CH_2)_4NH-CF_2CF_3$ (8)

$-(CF_2)_6CF_3$ (9)

$-(CH_2)_{10}C_8F_{17}$ (10)

$-CH_2N(C_2H_5)-SO_2C_8F_{17}$ (11)

$-(CH_2)_{10}N(CH_3)SO_2C_8F_{17}$ (12)

$-CH_2NHSO_2C_6F_{17}$ (13)

(14)

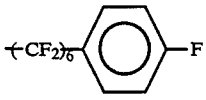

c.s-$CH_2CH_2-(CF_3)_6CF(CF_3)_2$ (15)

$-CH_2CF_2CF_2CF_3$ (16)

$-CH_2CH_2CH_2CH_2F$ (17)

$-CH_2(CF_2)_6CF_3$ (18)

-continued $-CH_2(CF_2)_5CF_3$ (19)

$-(CH_2)_3CF_3$ (20)

The following material (XI) can be selected for particular consideration from the above compounds.

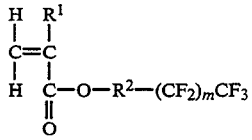

(XI)

where $R^1$ is either hydrogen, $-C_nH_{2n+1}$ or $-C_nF_{2n+1}$ (n is an integer, n=1 or $n \geqq 2$), $R^2$ is either $-(CH_2)_p$ (where p is an integer, $p \geqq 1$) or $-(CH_2)_qN(R^3)SO_2-$ (where $R^3$ is either $-CH_3$ or $C_2H_5$, q is an integer, $q \geqq 1$), and m is an integer equal to or greater than 6.

Accordingly, the following compounds are given as the most desirable compound for use as the member for the surface of the recording medium (A) of the present invention.

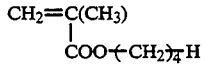

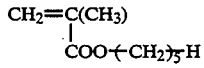

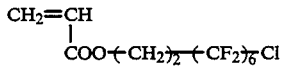

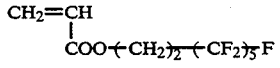

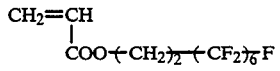

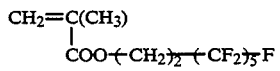

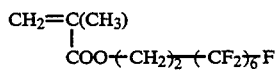

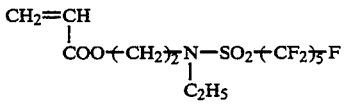

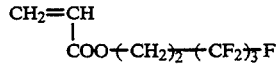

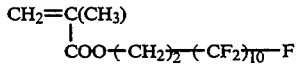

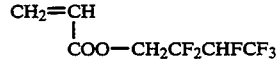

-continued

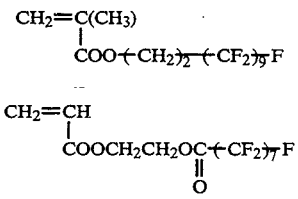

Moreover, a copolymer made of some of monomers indicated in (I) (II) (III) (IV) (V) (VI) (VII) and (XI) and other monomers such as ethylene, vinyl chloride, styrene, butadien, isoprene, chloroprene, vinyl alkyl ether, vinyl acetate and vinyl alcohol can be also used as the compound forming the surface of the recording medium (A).

In addition, a copolymer is made of a monomer represented by the formula (XI) and at least one of the following monomers each having a functional group.

$CH_2{=}C(CH_3)COO(CH_2)_2OH$ $CH_2{=}C(CH_3)COOCH_2CH(OH)CH_3$ $CH_2{=}CHCOOCH_2CH(OH)C_8F_{17}$

As a result, many functional groups are formed in the copolymer. In this manner, the manufactured substance has excellent properties as crosslinking type of polymer. Either formaldehyde, dialdehyde, N-Methylol compounds, dicarboxylic acid, dicarboxylic acid chloride, bis-halogen compounds, bis epoxide, bis aziridine, diisocyanate and the like can be used as the crosslinking agent. The following is one example of a crosslinking polymer obtained in this manner.

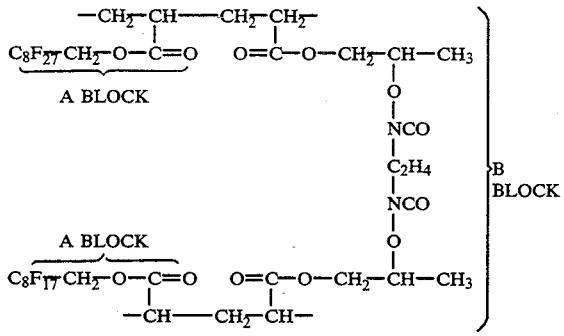

In the above formula, the A block is an alkyl group which brings on the previously described change in the thermal nature. The B block is the agent that crosslinks property of chain polymers (with diisocyanate being used as the crosslinking agent).

A liquid in which the above described copolymer and the crosslinking agent are mixed is coated on a substrate, and then either heating or irradiating electrons or light with respect to the substrate coated the liquid, so that a crosslinked film is formed on the substrate.

The process for obtaining the polymer from the monomer is selected in accordance with materials from solution polymerization, electrolysis polymerization, emulsification polymerization, photo polymerization, radiation polymerization, plasma polymerization, graft polymerization, plasma initiated polymerization, vapor deposition polymerization and the like.

A description will now be given of the compound indicated in FIG. 1B.

It is desirable that One of the following materials indicated by (XII), (XIII) and (XIV) be used for making the compound.

$R_f{-}COOH$ (XII)

$R_f{-}OH$ (XIII)

$R_f{-}(CH_2)_nSiX$ (XIV)

where, $R_f$ is either an alkyl group in which a carbon number is 4 or more, a group including an alkyl group in which fluoride or chloride is substituted for at least one hydrogen thereof, a hydrophobic group in which $-(CF_2)_l$, $-(CH_2)_l$ or —Ph— is included in the molecular chain (where $l \geqq 4$), m is an integer equal to or greater than 1, and X is either chlorine, methoxy group or ethoxy group.

On the above materials is physically absorbed or chemically connected to the surface of an inorganic material such as gold or copper or an inorganic material such as polyester or polyethyleneterephthalate (and preferably the material has a surface energy of approximately 50 dyn/cm or less).

The following are specific examples of the materials in formula (XII), (XIII) and (XV).

$CF_3{-}(CF_2)_5{-}COOH$ $CF_3{-}(CF_2)_7{-}COOH$ $CF_3{-}(CF_2)_7{-}(CH_2)_2{-}OH$ $H{-}(CF_2)_{10}{-}COOH$ $H{-}(CF_2)_{10}{-}CH_2OH$ $F{-}(CF_2)_6{-}CH_2CH_2{-}Si(CH_3)_2Cl$ $CF_2Cl(CF_3)CF(CF_2)_5COOH$ $CF_3(CF_2)_7(CH_2)_2SiCl_3$

The compound indicated in FIG. 1C can have a structure where there is only the material of (XII), (XIII) or (XIV).

A description will now be given of the recording medium (A) formed of the above compound.

The configuration of the recording medium (A) is such that it is (1) formed by the previously described surface member itself, or (2) formed by the previously described surface member on a supporting member (preferably a supporting member having heat resistance). The above compound (surface member) which applies to (1) above have either a plate or film shape, or can also be formed as a cylinder. In this case, it is desirable for a film shape to have a film thickness of between 1 um and 5 μm.

In a case of the compound pertaining to (2) above, it is permitted for the above described compound to permeate some distance into the supporting member. It is desirable that the film thickness of the recording medium (A) itself be from 30 Å to 1 mm. With respect to the thermal conductivity, a film thickness of between 100 Å and 10 um is better, and with respect to the friction resistance, a film thickness of 10 μm to 1 mm is better. It is desirable that the heat resist temperature of the supporting member be between 50° C. and 300° C.

The shape of the supporting member can also be a belt shape, a plate shape or a drum shape. The shape of the supporting member can be selected in accordance with the usage of an image forming apparatus. In particular, drum shapes have the advantage of being able to ensure good dimensional accuracy. In a case of plate shapes, the size of the plate is determined in accordance with the size of the recording sheet to be used.

Moreover, when a mixture made of the above compound (material formed on the surface of the recording medium (A)) and other material, such as hydrophobic polymer or hydrophobic inorganic material is formed on the supporting member, there is the advantage of preventing dirtying of a background of the image at printing. In addition, in order to raise the thermoconductivity, metal powder or the like can be mixed in the above described compound. Furthermore, in order to increase the adhesiveness between the supporting member and the above described compound, a primer layer can be provided between the supporting member and the compound. The thermal resistance supporting member can be formed of a resin film, such as a polyimide film, a polyester film or the like, a glass, a metal such as Ni, Al, Cu, Cr, Pt 10 or the like, or a metallic oxide. The surface of the supporting member can be smooth, rough or porous.

A description will now be given of the contact material (B).

The contact material (B) has been described above. The contact material (B) is either a liquid or a vapor from its initial state, or a solid which ultimately becomes a liquid at a temperature less than a temperature at which the receding contact angle $\theta_r$ of the recording medium (A) starts to decrease. Then, a liquid obtained by a condensation of the vapor wets the surface of the recording medium (A). At a temperature equal to or less than the temperature at which the receding contact angle $\theta_r$ starts to decrease, the solid changes into a liquid, generates a liquid, or generates a vapor. A liquid is obtained by the condensation of the vapor generated from the solid, and then the liquid wets the surface of the recording medium (A).

The contact material (B) is selected, for example, one of the following material.

In a case of the liquid, the contact material (B) is, in addition to the water, a water soluble liquid including electrolytes, n-butanol and other alcohol, glycerin, ethylene glycol and other multivalent alcohol, a liquid having polarity such as methyl ethyl ketone and other ketones, n-nonan, n-octane and liquids not having polarity such as other chain hydrocarbons, cyclohexane and other circular hydrocarbons, meta-xylene, benzene or other aromatic hydrocarbons. In addition, a substance which is mixture of the above materials is also suitable. Various types of dispersed liquids and liquid inks can also be used. The liquid having polarity are more suitable.

In a case of the vapor, the contact material (B) can be, in addition to the water, a vapor of the above material, particularly ethanol vapor and meta-xylene vapor and other vapors of organic compounds (including those that are mist state) can be used. A temperature of the vapors of organic compounds must be less than a melting point or a softening temperature of the compound which forms the surface of the recording medium.

In a case of the solid, the contact material (B) can be high-class fatty acids, low molecular weight polyethylene, macromolecules gel (polyacryl amido gel, polyvinyl alcohol gel), silica gel, or hydrated compound.

As will be described later, when the contact material (B) is a "recording agent which contains a colorant" such as the above described liquid inks, the formation of the latent image and the developing of the image are performed simultaneously.

The heating means can be a heater, a thermal head or another type of contact heating device.

Figure 2A:
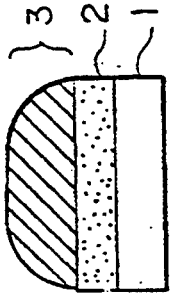
FIGS. 2A, 2B, 3A, 3B and 3C are views for describing the fundamental aspects of the image recording process according to the present invention.
Figure 2B:
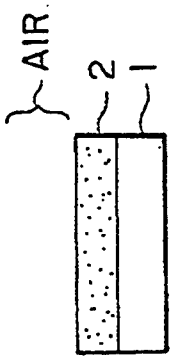

In FIG. 2A, a film 2 of the above described compound is formed on a substrate 1 so as to form the surface of the recording medium (A), and a liquid 3 of the contact material (B) exists on the film 2. In this state, when the film is heated, the receding contact angle $\theta_r$ on the surface of the film 2 decreases so that wetting appears on the surface of the film 2. That is, on the surface of the film, the adhesion of the liquid is recognized. In addition, when the film 2 having the adhesion of the liquid is heated again in a vacuum or in an atmosphere of an inert gas (FIG. 2B), the receding contact angle $\theta_r$ increases and then the water repellency can be recognized on the surface of the film 2.

A phenomena similar to the above phenomena is disclosed in Japanese Patent Publication No.54-41902, described above. However, this 10 disclosed process differs from the process of the present invention in that the recording material is effectively disordered and in that the mechanism obtains a layer of an amorphous memory substance. That is, in the present invention, it is not possible to have a change in the state of the surface of the recording medium (A) without the contact material (B). In addition, in the process disclosed in Japanese Patent Publication No.54-41902, it is not possible to obtain the reversible change by a simple operation.

Figure 3A:
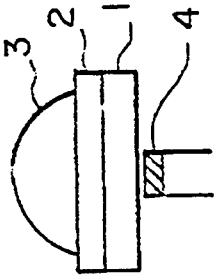

As shown in FIG. 3A, when the film 2 is heated in accordance with an image information signal in a condition in which the liquid 3 is in contact with the surface of the film 2, the adhesion property of the liquid is obtained on a portion, which is heated, of the film 2. In this case, a heater 4 turns on and off in accordance with the image information signal.

Figure 3B:
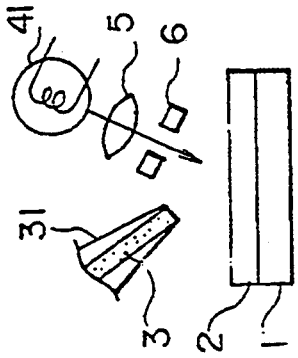
Figure 3C:
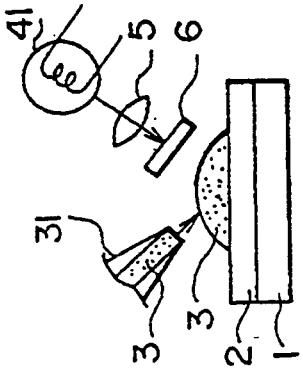

In a case shown in FIGS. 3B and 3C, heat radiation from a infra-red heater 41 is irradiated to the film 2 via a lens 5 and a shutter so that the film 2 is heated in a condition in which there in no liquid thereon, then after the shutter 6 is closed, the liquid 3 is supplied from a liquid supply opening 31 to the film. That is, in this case, after the film 2 is heated, the liquid 3 is provided on the surface of the film 2. The shutter 6 is opened and closed in accordance with the image information.

Figure 4:
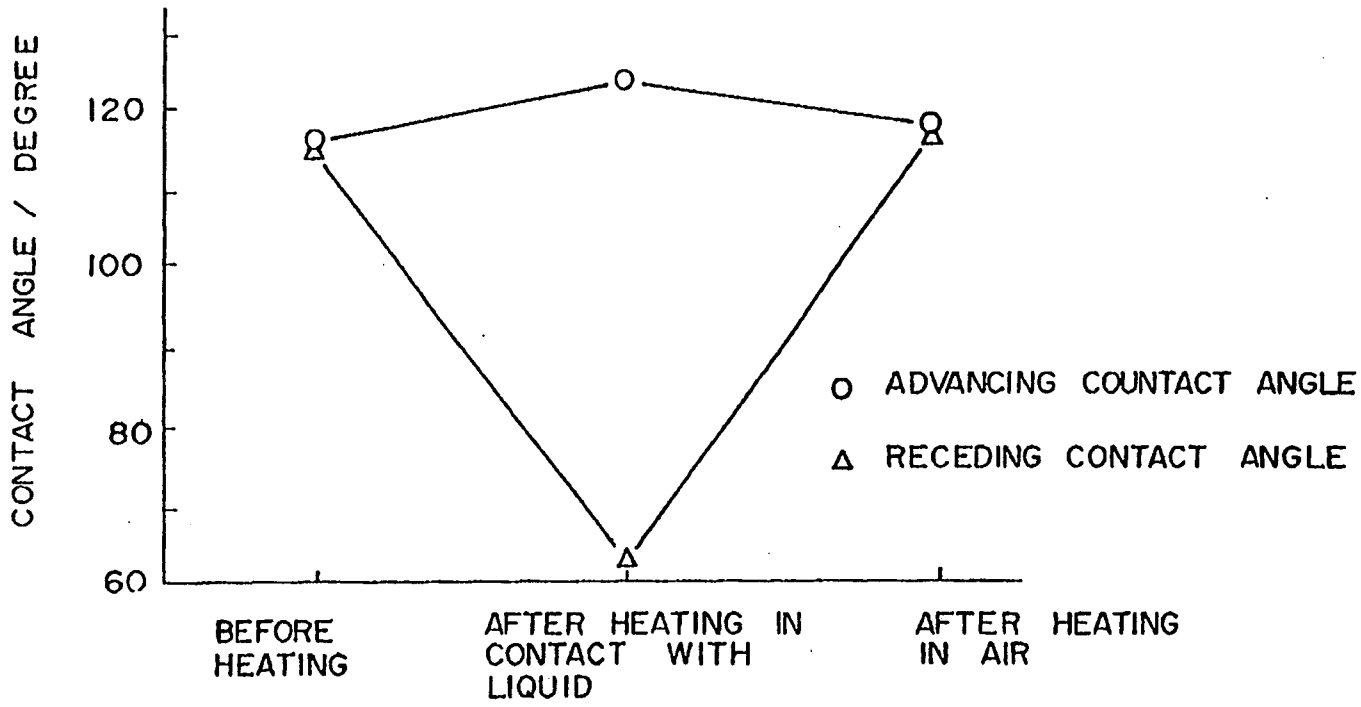
FIG. 4 is a graph indicating the changes in the advancing contract angle and the receding contact angle in the surface of the recording medium.

FIG. 4 is a graph illustrating contact angles of a water-soluble liquid on the film 2 prior to heating the film 2 and after heating film 2 in a condition where the water-soluble liquid is in contact with the film 2. FIG. 4 also illustrates contact angles of the water-soluble liquid when the film 2 is further heated in air. In FIG. 4, ○ denotes the advancing contact angle, and Δ denotes the receding contact angle.

In general, when the receding contact angle is a high value equal to or greater than 90, the surface of the substance exhibits liquid repellency. When the receding contact angle is a low value less than 90°, the surface of the substance exhibits liquid adhesion.

In a state where the contact material (B) is in contact with the recording medium (A), the recording medium (A) should be heated at a temperature between 50° C. and 250° C., but preferably should be heated at a temperature between 80° C. and 150° C. The heating time should be in the range of 0.1 msec to 1 sec., but preferably should be in the range of 0.5 msec to 2 msec. The heating timing is determined as follows. In a case of forming a latent image, (1) when the surface of the recording medium (A) is heated, and then the temperature of the recording medium is not less than a predetermined temperature, the contact material (B) is brought into contact with the recording medium (A). (2) In a state where the contact material (B) is in contact with the surface of the recording medium (A) (the liquid is in contact with the surface of the recording medium), the surface of the recording medium (A) is heated. Either the above (1) or (2) can be carried out. In a case of erasing the latent image, the recording medium (A) should be heated at a temperature between 50° C. and 300° C., but preferably should be heated at a temperature between 100° C. and 180° C. The heating time should be in a range of 1 msec. to 10 sec, but preferably should be in a range of 10 msec. to 1 sec.

A detailed description will now be given of means for recording image information on the surface of the recording medium (A).

Figure 5A:
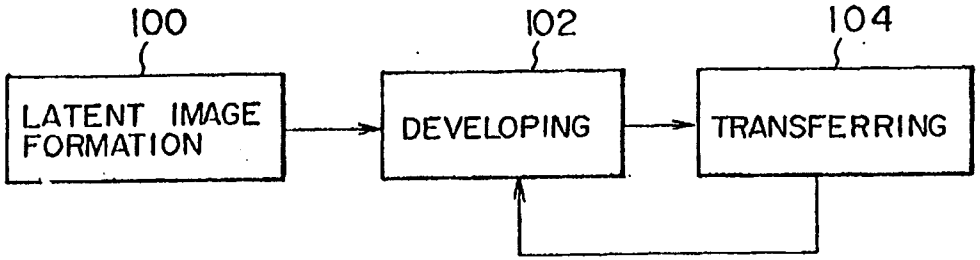
FIGS. 5A and 5B are block diagrams illustrating recording processes according to the present invention.

As shown in FIG. 5A, the surface of the recording medium (A) is heated in accordance with a image information signal in a condition where a liquid is provided on the surface of the recording medium (A) or in a vapor atmosphere, and thus liquid adhesion areas are formed on the surface of the recording medium (A) (latent image formation step 100). After this, a recording agent is brought into contact with the surface of the recording medium (A) so that the recording agent adheres to the latent image portion (developing step 102).

Then, the image formed by the recording agent is transferred to a recording sheet (transferring step 104). This process for recording image on the recording sheet is often referred to as an indirect recording process. Furthermore, if the step where the recording agent is brought into with the latent image portion on the surface of the recording medium (A) and the step where the image formed by the recording agent is transferred to the recording sheet are sequentially repeatedly carried out, the images are successively formed on the recording sheets. That is, a printing process in which the recording medium (A) is used as a printing plate is obtained.

Figure 5B:
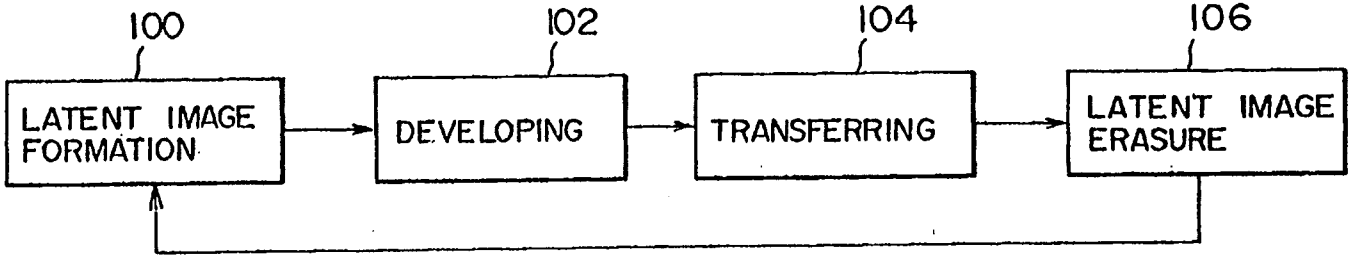

As shown in FIG. 5B, after the latent image formation step 100, the developing step 102 and the transferring step 104 are sequentially carried out, the surface of the recording medium (A) is heated without the liquid or the vapor so that the latent image is erased from the surface of the recording medium (A) (erasing step 106). That is, an image forming process in which it is possible to repeatedly form different latent image on the surface of the recording medium (A). This process for repeatedly forming the image on the recording medium (A) is referred to as a repeat recording process.

A description will now be given of a conceptual structure of a mechanism for recording an image in accordance with the above described process.

If the recording medium (A) has the surface on which the receding contact angle decreases when the liquid is brought into contact with the surface and the surface is heated, the recording medium (A) can have any shape. The surface having the above characteristic will be hereinafter termed the "film 2" or the "surface of the recording medium (A)". The recording medium (A) can be either a rigid cylindrical shape or a flexible film shape. As the recording medium (A) having a rigid cylindrical shape can be accurately rotated around an axis thereof, the recording medium (A) having a rigid cylindrical shape is superior in a controllability.

Figure 6A:
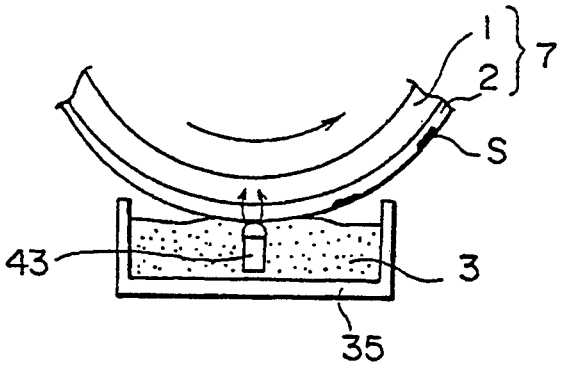
FIGS. 6A and 6B are views illustrating examples of a mechanism for forming a latent image.

A mechanism for forming a latent image on the recording medium is formed, for example, as shown in FIG. 6A.

Referring to FIG. 6A, a vat 35 filled with a liquid 3 is provided at the lower portion of a recording medium 7. The recording medium 7 is constituted by a substrate 1 having a rigid cylindrical shape and a film 2 formed on the substrate 1, which film 2 having the novel characteristic regarding the variation of the receding contact angle. The recording medium 7 can be formed of only a material of the film 2. The recording medium 7 having the substrate 1 and the film 2 are superior to that formed only the material of the film 2 in a strength. The lower surface (the film 2) of the recording medium 7 is always in contact with the liquid 3 in the vat 35. A thermal head 43 (a heat source) is mounted in the vat 35 so that the film 2 is heated in a condition where the liquid 3 is in contact therewith. In the mechanism shown in FIG. 6A, when the thermal head 43 is turned on and off in accordance with image data, liquid adhesion areas to which the liquid can adhere are formed on the surface of the recording medium 7 so that a latent image S is formed thereon.

Figure 6B:
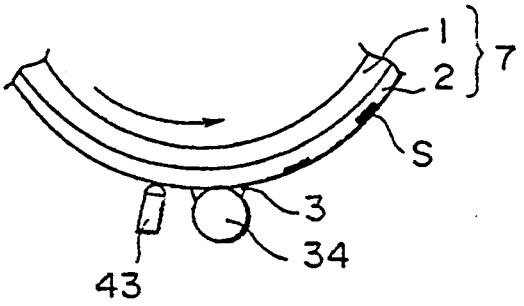

Another mechanism for forming a latent image is shown in FIG. 6B.

Referring to FIG. 6B, a sponge type of porous substance 34 filled with the liquid 3 is provided so as to be in contact with the surface of the recording medium 7. A thermal head 43 is provided at a position upstream side of the porous substance 34. After the surface of the recording medium 7 is selectively heated by the thermal head 43, the liquid 3 is supplied from the porous substance 34 to the heated surface of the recording medium 7. Thus, liquid adhesion areas are formed on the recording medium 7 so that a latent image S is formed thereon.

A mechanism for making recording agent adhere to the liquid adhesion area obtained in a manner as described above is shown, for example, in FIG. 7.

Figure 7:
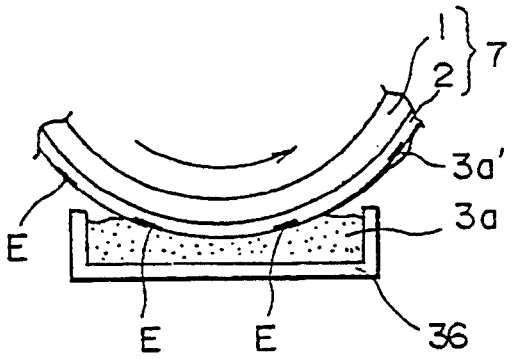
FIGS. 7 and B are views illustrating examples of a mechanism for developing the latent image.

Referring to FIG. 7, a vat 36 filled with recording agent 3*a* (solution or dispersing liquid) such as ink is provided at a position down stream side of means for forming a latent image in a rotating direction of the recording medium 7. The surface of the recording medium 7 (the film 2) is in contact with the recording agent 3*a* in the vat 36. When the liquid adhesion areas E (the latent image) formed on the film 2 is brought into the recording agent 3*a* in the vat 36, the recording agent 3*a* adheres to the liquid adhesion areas E. A visible image is formed of the recording agent 3*a*′ adhering to the surface of the recording medium 7.

Figure 8:
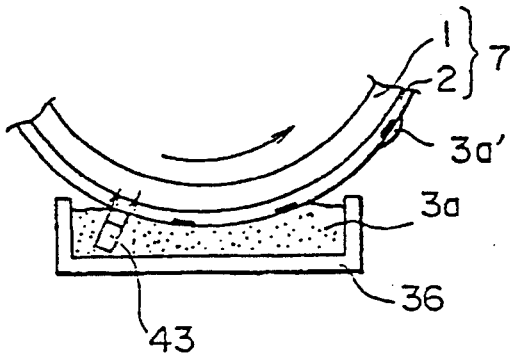

FIG. 8 shows a mechanism for forming a latent image and visible image on the recording medium 7.

Referring to FIG. 8, the vat 36 filled with solution or dispersing liquid of the recording agent 3*a* is provided so that the surface of the recording medium 7 is in contact with the solution or the dispersing liquid. A thermal head 43 is mounted in the vat 36 so that the film 2 is heated in a condition where the solution or dispersing liquid is in contact with the film 2. In this mechanism, the film 2 is selectively heated by the thermal head in a condition where the solution or the dispersing liquid of the recording agent is in contact therewith, so that a latent image (constituted by liquid adhesion areas) is formed. AT the same time, the latent image is developed by the recording agent 3*a*. That is, the recording agent 3*a* adheres to the liquid adhesion areas. Thus, a visible image is formed of the recording agent 3*a*' adhering to the surface of the recording medium 7.

According to the mechanism shown in FIG. 8, as a formation of a latent image and a developing of the latent image approximately simultaneously performed, a down sizing of the mechanism can be executed.

Figure 9:
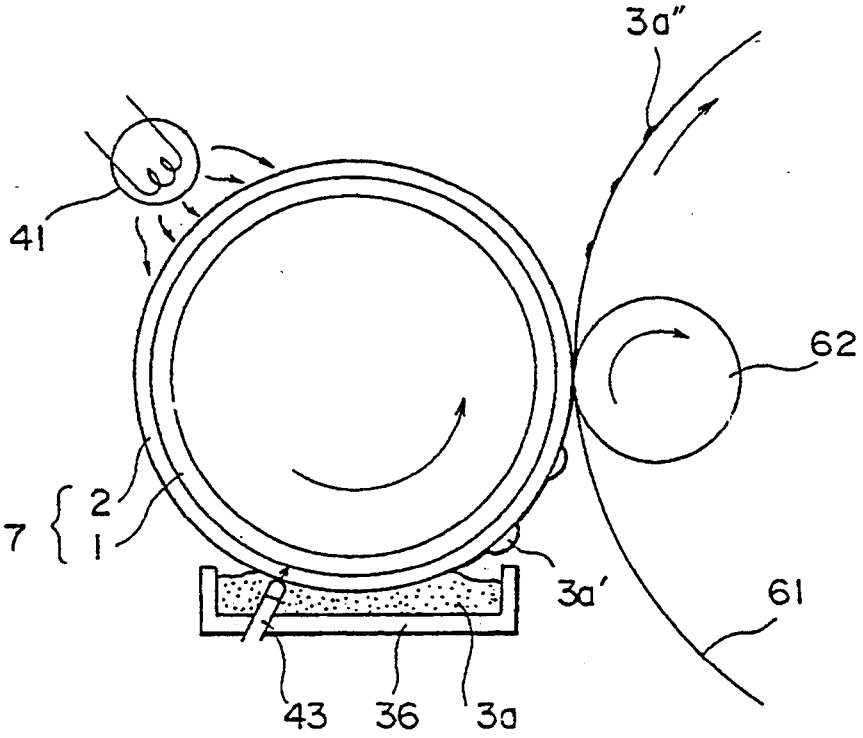
FIG. 9 is a diagram illustrating an example of an apparatus for forming an image.

FIG. 9 shows an example of a printer operating in accordance with the process according to the present invention.

Referring to FIG. 9, the recording agent 3*a* is-filled in the vat 36. In a state where a lower surface of the recording medium 7 is in contact with the recording agent 3*a*, the recording medium 7 is rotated around an axis thereof at a predetermined speed. A thermal head 43 is provided in the vat 36 so that the surface of the recording medium 7 is selectively heated under a condition in which the recording agent 3*a* (the solution or the dispersing liquid) is in contact with the surface of the recording medium 7. As has been described above, the recording agent 3*a* adheres to the heated areas of the surface of the recording medium 7. Thus, recording agent 3*a*' adhering to the recording medium 7 forms a visible image. Then the recording agent 3*a*' adhering to the surface of the recording medium 7 is transferred to a recording sheet 61 fed between the recording medium 7 and a roller 62. As a result, the recording agent 3*a*'' adhering to the recording sheet 61 forms a visible image. That is, a visible image is formed on the recording sheet 61. A transferring mechanism for transferring the recording agent 3*a*' from the recording medium 7 to the recording sheet 61 is arranged so that the transferring process is carried out after the developing process. It is preferable that the transferring process be carried out immediately after the developing process.

After the transferring process between the recording medium 7 and the recording sheet 61, in a state where the liquid or the vapor is not present (in air, vacuum or inert gas), an infra-red heater 41 heats the surface of the recording medium on which the latent image remains. The latent image is erased from the surface of the recording medium due to the heating by the infra-red heater 41. When the latent image is erased from the surface of the recording medium 7, the recording member 7 can be reused for forming a new image.

In the apparatus shown in FIG. 9, when the infra-red heater 41 is inactivated, the latent image is not erased from the surface of the recording medium. In this case, a plurality of images each corresponding one latent image can be formed on the recording sheets.

In addition, the heating device used for erasing the latent image can be a heater, a thermal head or other contact types of heating device, but can also be a non-contact type of heating device using the electromagnetic radiation, such as a laser or an infra-red. The heating can be performed for the entire surface or can be performed only a part of the surface on which the latent image is formed. To obtain a compact apparatus, it is preferable that a mechanism for heating the entire surface of the recording medium 7 be provided in the apparatus. After the surface of the recording medium 7 is heated so as to erase the latent image, the surface of the recording medium 7 is effectively cooled to a notmal temperature in a time until the next latent image is formed. The heating temperature required for erasing the latent image is set based on the material of the surface of the recording medium 7. This heating temperature should preferably be a temperature within a range between the decomposition point of the material forming the surface of the recording medium 7 (the film 2) and a temperature at which the receding contact angle starts to decrease of the surface of the recording medium 7 (the film 2).

The recording sheet 61 can be a transparent resin film, a plain paper, an ink jet recording paper, a typing paper or the like.

A description will now be given of the recording agent.

In the recording process for obtaining a visible image on the surface of the recording medium (A), the recording agent can be ink for writing, ink for ink jet printing, printing ink, electrostatic transfer toner or some other recording agent used in conventional printing processes.

Therefore, in the case of the specific example of water-soluble ink, it is possible to use water-soluble ink containing water, humectants and dye as the main components, water based pigment dispersal inks that have water, pigments macromolecule compounds for dispersal and humictants as the main components, or emulsion inks in which pigments or dyes are the surface activated agents that are dispersed in water. The humictants used in water based inks can be any of the following water-soluble organic compounds:

ethanol, methanol, propanol and other monovalent alcohol;

ethylene glycol, diethylene glycol, triethylene glycol, tetraethylene glycol, polyethylene glycol, propylene glycol, dipropylene glycol, glycerin and other multivalent alcohol;

ethylene glycol monobutyl ether, diethylene glycol monomethyl ether, triethylene glycol monomethyl ether, tetraethylene monomethyl ether, propylene glycol monomethyl ether, ethylene glycol, diethylene glycol monoethyl ether, triethylene glycol monoethyl ether, tetraethylene glycol monoethyl ether, propylene glycol monoethyl ether and other multivalent alcohol ethers;

N-methyl-2-pyrrolidone, 1,3-dimethyl-imidazolricinon, ϵ-caprolactam and other heterocyclic compounds; and monoethanol amine, diethanol amine, triethanol amine, monoethyl amine, diethyl amine, triethyl amine and other amines.

The water-soluble dye can be a dye which is classified by the color index into acid dyes, direct dyes, basic dyes, and reactive dyes. The examples of dyes are indicated as follows.

C.I. acid yellow: 17, 23, 42, 44,79, 142

C.I. acid red: 1, 8, 13, 14, 18, 26, 27, 35, 37, 42, 52, 82, 87, 89, 92, 97, 106, 111, 114, 115, 134, 186, 249, 254, 289

C.I. acid blue: 9, 29, 45, 92, 249, 890

C.I. acid black: 1, 2, 7, 24, 26, 94

C.I. food yellow: 3, 4

C.I. food red: 7, 9, 14

C.I. food black: 2

C.I. direct yellow: 1, 12, 24, 26, 33, 44, 50, 142, 144, 865

C.I. direct red: 1, 4, 9, 13, 17, 20, 28, 31, 39, 80, 81, 83, 89, 225, 227

C.I. direct orange: 26, 29, 62, 102

C.I. direct blue: 1, 2, 6, 15, 22, 25, 71, 76, 79, 86, 87, 90, 98, 163, 165, 202

C.I. direct black: 19, 22, 32, 38, 51, 56, 71, 74, 75, 77, 154, 168

C.I. basic yellow: 1, 2, 11, 14, 15, 19, 21, 23, 24, 25, 28, 29, 32, 36, 40, 41, 45, 49, 51, 53, 63, 65, 67, 70, 73, 77, 87, 91

C.I. basic red: 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, 112

C.I. basic blue: 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, 155

C.I. basic black: 2, 8

The pigment can be organic pigment such as azo pigment, phthalocyanine pigment, anthraquinone pigment, quinacridone pigment, dioxazine pigment, indigo pigment, dioindigo pigment, perynone pigment, perylene pigment, iso-indolenone pigment, aniline black, azomethine azo pigment, carbon block and others. The inorganic pigment can be iron oxide, titanium oxide, calcium carbonate, barium sulfate, ammonium hydroxide, barium yellow, prussian blue, cadmium red, chrome yellow and metal powder.

The dispersed pigment compounds can be polyacrylamide, polyacrylate and other alkali metallic salt, soluble styrene acrylic resin and their acryl family resin, soluble vinyl naphthalene acid resin, polyvinyl pyrrolidone, polyvinyl alcohol, and its alkali salt, macromolecule compound which includes salt with cation functional group such as ammonium and amino group etc., polyethylene oxide, gelatin, casein and other proteins, arabia rubber, traganth rubber and other natural rubber, saponin and other glucoxide, carboxy-methyl cellulose, hydroxyethyl cellulose, methyl cellulose and other cellulose inductors, lignin sulfonic acid and its salt, ceramics and other natural macromolecule compounds, and the like.

The oil-based type of solution or dispersing liquid of recording agent can be those in which lipophilic pigment is dissolved in an organic compound, those in which pigment is dispersed in an organic compound, those in which pigment or colorant is emulsified in an oil base, and the like.

Representative examples of the oil-based type dyes are indicated as follows:

C.I. solvent yellow: 1, 2, 3, 4, 5, 6, 7, 8, 9, 10, 11, 12, 14, 16, 17, 26, 27, 29, 30, 39, 40, 46, 49, 50, 51, 56, 61, 80, 86, 87, 89, 96

C.I. solvent orange: 12, 23, 31, 43, 51, 61

C.I. solvent red: 1, 2, 3, 16, 17, 18, 19, 20, 22, 24, 25, 26, 40, 52, 59, 60, 63, 67, 68, 121

C.I. solvent violet: 7, 16, 17,

C.I. solvent blue: 2, 6, 11, 15, 20, 30, 31, 32, 35, 36, 55, 58, 71, 72

C.I. solvent brown: 2, 10, 15, 21, 22

C.I. solvent black: 3, 10, 11, 12, 13.

In addition, oil bases in which pigment is dissolved or in which pigment is dispersed include n-octane, n-decane, Milanese spirit, ligroin, naphtha, benzene, toluene, xylene and other hydrocarbons; dibytyl ether, dihexyl ether, anisole, phenetole, dibenzyl ether and other ethers; and methanol ethanol, isopropyl alcohol, benzyl alcohol, ethylene glycol, diethylene glycol, glycerin and other alcohol.

It is also possible to use the above described pigments for the oil-based inks as well. Examples of the oil-based pigment dispersal agents include polymethacrylic acid ester, polyacrylic acid ester, methacrylic acid ester-acrylic acid ester copolymer, polyacetic acid vinyl, vinyl chloride-vinyl acetate copolymer, polyvinyl pyrrolidone, polyvinyl butyral and other vinyl copolymers, ester cellulose, methyl cellulose and other cellulose resins, polyester, polyamide, phenol resin and other polymer resins, rosin, ceramics, relative, casein and other natural resins and the like.

In the present invention, it is preferable that the water-soluble ink is used as the solution or dispersing liquid of the recording agent.

When a dot image was formed on a recording sheet by using a thermal head in accordance with the process described above. there was a case where a clear image is not obtained. The inventors discovered the following cause of not obtaining the clear image.

Each of liquid adhesion areas (herein after referred to as latent image dots) formed on the recording medium has almost a square shape or a rectangular shape corresponding to the shape of each heating element in the thermal head. In this case, when the recording medium is moved relative to the liquid ink, liquid ink dollops adhering to adjacent latent image dots can be easily connected to each other. Thus, for example, a character dot image is easily defaced, so that the quality of the image deteriorates.

A description will now be given of a phenomena in which the liquid ink dollops adhering to adjacent latent image dots are easily connected to each other, with reference to FIGS. 10 and 11. A thermal head has square-shaped heating elements arranged in a line so that adjacent heating elements separated from each other at a distance $d_1$. Thus, in FIGS. 10 and 11, square-shaped latent image dots are formed on the recording medium, and a distance between adjacent latent image dots is maintained at $d_1$.

Figure 10:
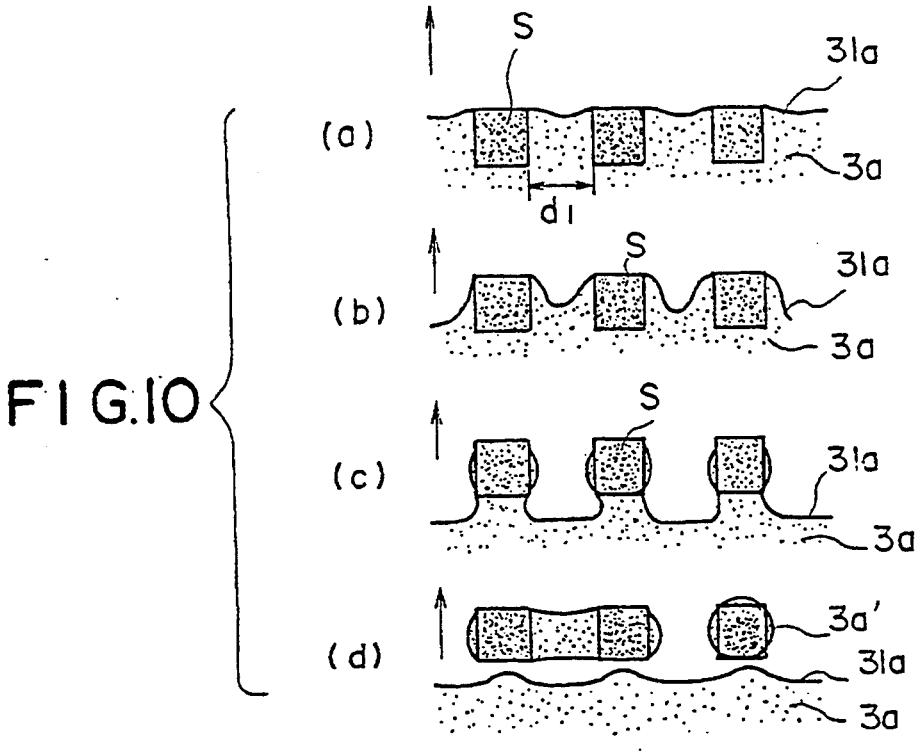
FIGS. 10, 11, 12 and 13 are detailed views illustrating process for developing the latent image.
Figure 11A:
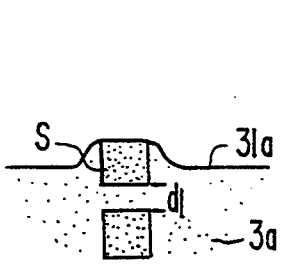
Figure 11B:
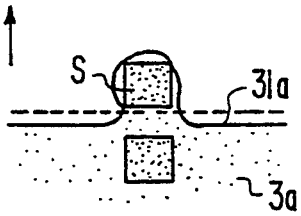
Figure 11C:
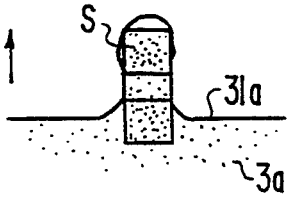
Figure 11D:
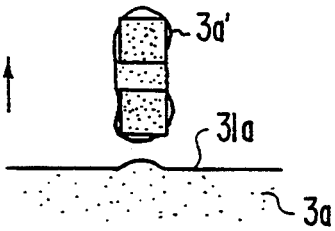

Referring to FIG. 10, the recording medium (A) is moved in a moving direction perpendicular to a direction in which the heating elements of the thermal head is arranged, so that the square-shaped latent image dots S formed on the recording medium (A) are arranged in a direction perpendicular to the moving direction of the recording medium (A). While the recording medium (A) is moved in the moving direction shown by an arrow in FIG. 10, the square-shaped latent image dots S move relative to the liquid ink 3*a* being in contact with the surface of the recording medium (A). The square-shaped latent image dots S pass through the liquid ink 3*a* as shown in FIGS. 10 (*a*), (*b*), (*c*) and (*d*).

A leading edge of each of the square-shaped latent image dots S reaches a border 31*a* of the liquid ink 3*a*, as shown in FIG. 10 (*a*).

The square-shaped latent image dots S move under a condition in which the liquid ink adheres to the square-shaped latent image dots S, so that border 31*a* of the ink 3*a* proceed, as shown in FIG. 10 (*b*).

The square-shaped latent image dots S further move, but an ink liquid dot adhering to each of the square-shaped latent image dots S is not yet separated from the border 31*a* of the liquid ink 3*a*, as shown in FIG. 10 (C).

When ink liquid dots adhering to adjacent square-shaped latent image dots S are separated from the border 31*a* of the liquid ink 3*a*, they are brought into contact with each other. As a result, the liquid ink dollops 3*a*' adhering to the adjacent square-shaped latent image dots S are connected to each other by attraction thereof, as shown in FIG. 10 (*d*).

FIG. 11 shows a case in which liquid ink dollops adhering to adjacent square-shaped latent image dots S arranged in the moving direction in which the recording medium (A) moves are connected to each other. The square-shaped latent image dots S pass through the liquid ink 3*a* as shown in FIGS. 11 (*a*), (*b*), (*c*) and (*d*).

In this case, a width of an end of each of the square-shaped latent image dot S is relatively large. Thus, when each of the square-shaped latent image dots S passes through the liquid ink 3*a*, the amount of ink located between the border 31*a* of the liquid ink 3*a* and the liquid ink dollop adhering to each of the latent image dots S is large, as shown in FIG. 11 (*b*). As a result, when a leading end of the next square-shaped latent image dots S reaches the border 31*a* of the liquid ink, the liquid ink dollop adhering to each of the square-shaped latent image dots is not yet separated from the border 31*a* of the liquid ink 3*a*, as shown in FIG. 11 (*c*). In the above state, when the recording medium (A) is further moved, liquid ink dollops adhering to adjacent square-shaped latent image dots S arranged in the moving direction are connected to each other, as shown in FIG. 11 (*d*).

In the present invention, a shape of each of the latent image dots S formed on the recording medium (A) is improved to prevent liquid ink dollops adhering to adjacent latent image dot from being connected to each other, as described above.

Figure 12:
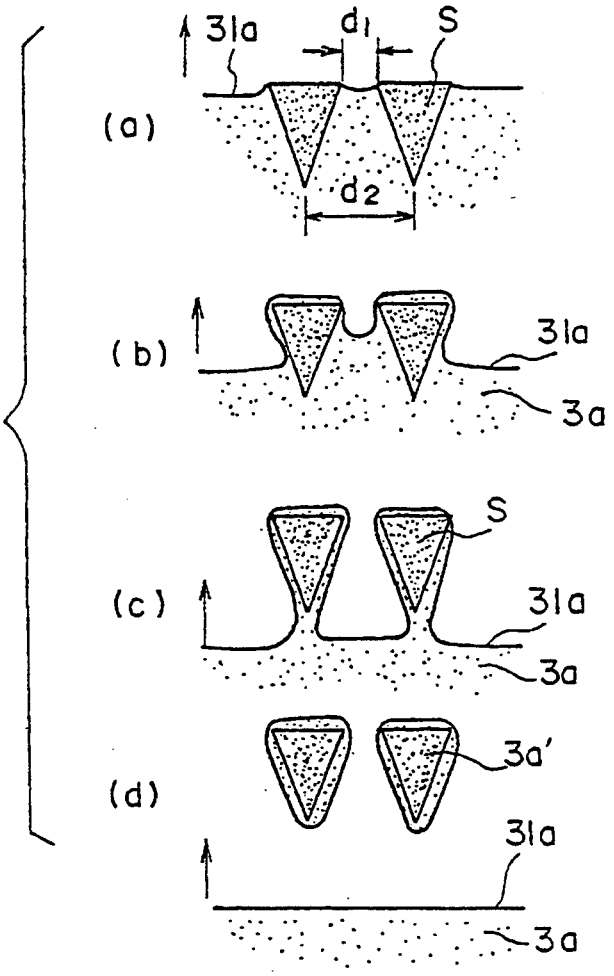

In a case shown in FIG. 12, each of the latent image dots S has a triangle shape which becomes narrower in a direction opposite to the moving direction. In this case, the latent image dots S passes through the liquid ink 3*a* as shown in FIGS. 12 (*a*), (*b*), (*c*) and (*d*). States shown in FIGS. 12 (*a*), (*b*), (*c*) and (*d*) respectively correspond to those shown in FIGS. 10 (*a*), (*b*), (*c*) and (*d*). A distance $d_2$ between ends of adjacent latent image dots S is larger than a distance $d_1$ between leading edges of the adjacent latent image dots S. Thus, when liquid ink dollops adhering to the adjacent latent image dots are separated from the border 31*a* of the liquid ink 3*a*, as shown in FIGS. 12 (*c*) and (*d*), it is hard for the liquid dollops to interrupt each other. That is, the liquid ink dollops adhering to the adjacent latent image dot can be prevented from being connected to each other.

Figure 13:
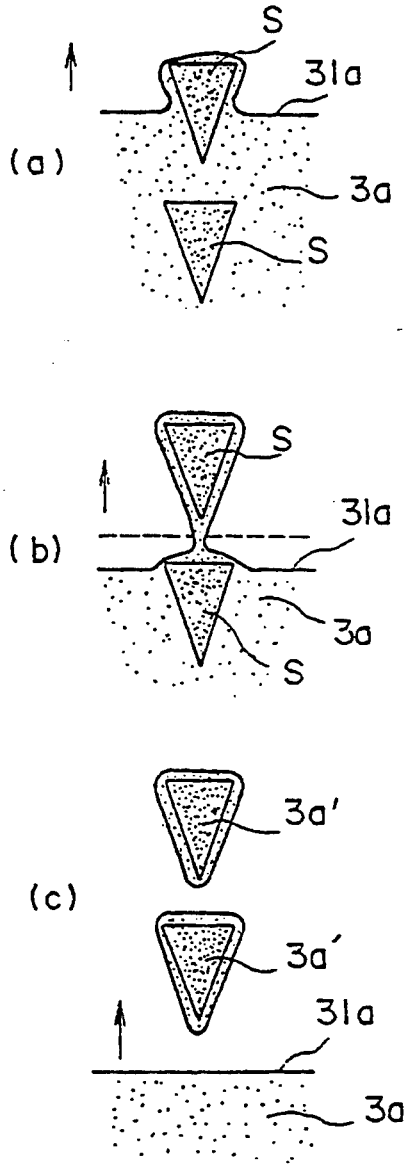

FIG. 13 shows a case where the latent image dots formed on the recording medium (A) is arranged in the moving direction. In this case, each of the latent image dots has a triangle shape becoming narrower in a direction opposite to the moving direction. The latent image dots S passes through the liquid ink 3*a* as shown in FIGS. 13 (*a*), (*b*) and (*c*). A state shown in FIG. 13 (*a*) correspond to that shown in FIG. 11 (*a*), a state shown in FIG. 13 (*b*) corresponds to that shown in FIG. 11 (*c*), and a state shown in FIG. 13 (*c*) corresponds to that shown in FIG. 11 (*d*).

Since each of the latent image dots becomes narrower in the direction opposite to the moving direction, when a leading end of the next latent image dot reaches the border 31*a* of the liquid ink 3*a*, the amount of ink located between the border 31*a* of the liquid ink 3*a* and the liquid ink dollop adhering to each of the latent image dots is small. Thus, even if the leading end of the next latent image dot reaches the border 31*a* of the liquid ink 3*a*, the liquid ink dollop adhering to each of the latent image dots can be easily separated from the border 31*a* of the liquid ink 3*a*.

In addition, in a case where each of the latent image dots becomes narrower in the direction opposite to the moving direction, as shown in FIGS. 12 and 13, as the amount of ink located between the border 31*a* of the liquid ink 3*a* and the liquid ink dollop adhering to each of the latent image dots is small, it is hard for the border 31*a* of the liquid ink 3*a* to be disturbed. Thus, the developing process can be stably carried out.

FIGS. 14 through 17 shows examples of shapes of heater elements in the thermal head which can be preferably used in the process according to the present invention. When latent image dots are formed on the recording medium by using the thermal head having the heating elements as shown in FIGS. 14 through 17, each of the latent image dots becomes narrower in a direction opposite to the moving direction, in which the recording medium is moved relative to the liquid ink, on a part at least close to the end of each of the latent image dots.

Figure 14:
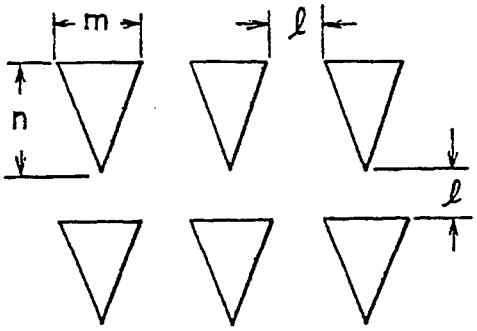
FIGS. 14, 15, 16 and 17 are views illustrating examples of a shape of each of thermal elements in a thermal head.

Each of the heating elements shown in FIG. 14 has a triangular shape. Each of the heating elements shown in FIG. 15 has a pentagonal shape. Each of the heating elements shown in FIG. 16 has a rhombic shape. Each of the heating elements shown in FIG. 17 has a hexagonal shape.

To prevent the liquid ink dollops adhering to adjacent latent image dots from interrupting to each other, the smallest distance between adjacent latent image dots is set so as to fall within a range of 5–100 μm, and preferably within a rage of 10–30 μm. The length (in the moving direction) or the width (perpendicular to the moving direction) of each of the latent image dots is set so as to fall within a range of 10–200 μm, and preferably within a range of 30–100 μm.

The latent image dots as shown in FIGS. 14 through 17 can be formed on the recording medium by using a non-contact heating device, such as a laser unit.

EXAMPLES

EXAMPLE 1

An acrylate material including fluorine (17F manufactured by OSAKA ORGANIC MANUFACTURING CO., LTD) of 3 ml was diluted with freon TF (manufactured by MITSUI FLUORO CHEMICAL CO., LTD) of 6 ml. After this, a material obtained by the above dilution was coated on a cylindrical substrate formed of polyimide film (manufactured by TORAY-DUPONT CO., LTD). The structure in which the the material was coated on the cylindrical substrate was dried at 100° C. for 30 min., so that a recording medium was made. The recording apparatus using the above recording medium was constituted as shown in FIG. 9. Water-soluble black ink was used as the recording agent. The thermal head having the heating elements shown in FIG. 14 was used, where $m \approx 100$ μm, $n \approx 100$ μm and a distance (1) between lines was 20 μm.

When a printing was carried out under the above conditions, an dot image having high quality was formed on the recording sheet 61. In addition, the recording agent remains on the surface of the recording medium (A) little.

EXAMPLE 2

Figure 15:
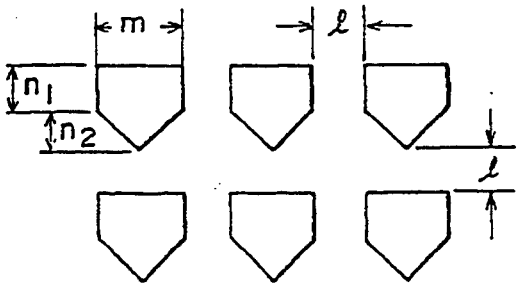

The thermal head having heating elements shown in FIG. 15 was used, where $m \approx 100$ μm, $n_1 \approx 50$ μm, $n_2 \approx 50$ μm and a distance (1) between lines was 20 μm. Other conditions was the same as those in Example 1.

In this case, as an area of each of the heating elements was wider than that of each of the heating elements used in Example 1, the amount of ink dollop adhering to each of the latent image dots was larger than that of ink dollop obtained in Example 1. As a result, an dot image more contrasty than that in Example 1 was obtained.

EXAMPLE 3

Figure 16:
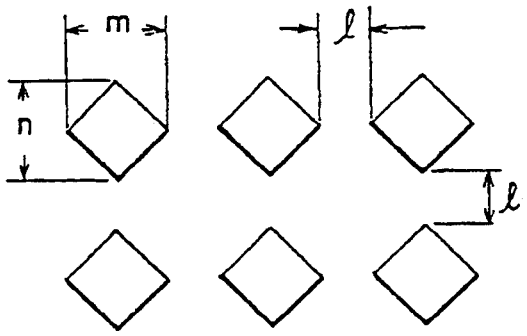

The thermal head having heating elements shown in FIG. 16 was used, where $m \approx 100$ μm, $n \approx 100$ μm and a distance (1) between lines was 20 μm. Other conditions was the same as those in Example 1.

In this case, the amount of residual ink adhering to a lead edge of each of the latent image dots was less than that of residual ink obtained in Example 1. Thus, the quality of an dot image formed on the recording sheet 61 was higher than that of the dot image obtained in Example 1.

EXAMPLE 4

Figure 17:
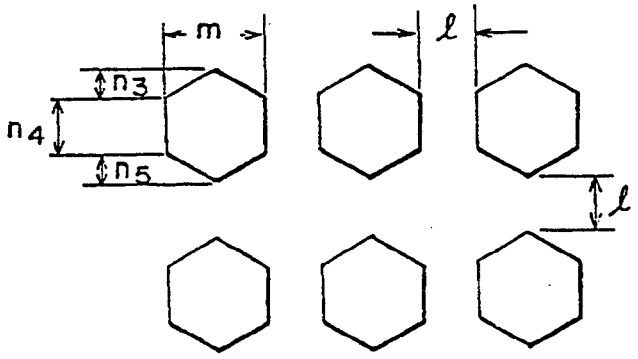

The thermal head having heating elements shown in FIG. 17 was used, where $m \approx 100$ μm, $n_3 \approx 30$ μm, $n_4 \approx 40$ μm, $n_5 \approx 30$ μm and a distance (1) between lines was 20 μm.

In this case, a contransty dot image in which there was no defaced character was obtained.

The present invention is not limited to the aforementioned embodiments, and variations and modifications may be made without departing from the scope of the claimed invention.

What is claimed is:

1. A process for forming a dot image on a recording medium, a surface of said recording medium having a characteristic in which a receding contact angle decreases when said recording medium is heated under a condition in which a liquid is in contact with the surface of said recording medium, said process comprising the steps of:

(a) forming a latent image having a plurality of pentagonal shaped dots, said step (a) comprising the steps of:

(a-1) bringing a contact material into contact with the surface of said recording medium, said contact material being selected from the group consisting of a liquid, vapor and a solid which generates or changes to either vapor or a liquid under a condition of a temperature lower than a temperature at which the receding contact angle of the surface of said recording medium starts to decrease; and (a-2) selectively heating an area on the surface of said recording medium, said area corresponding to each of the dots which form the latent image, so that said area having the receding contact angle whose value corresponds to a temperature of said area heated by said step (a-2) becomes each of the dots which make up the latent image; and (b) developing the latent image obtained in said step (a) by a liquid recording agent relative to which said recording medium is moved in a moving direction, wherein each of the pentagonal shaped dots which make up the latent image obtained in step (a) becomes narrower in a direction opposite to the moving direction in a portion close to an end of each of the dots.

2. A process for forming a dot image on a recording medium, a surface of said recording medium having a characteristic in which a receding contact angle decreases when said recording medium is heated under a condition in which a liquid is in contact with the surface of said recording medium, said process comprising the steps of:

(a) forming a latent image having a plurality of hexagonal shaped dots, said step (a) comprising the steps of:

(a-1) bringing a contact material into contact with the surface of said recording medium, said contact material being selected from the group consisting of a liquid, vapor and a solid which generates or changes to either vapor or a liquid under a condition of a temperature lower than a temperature at which the receding contact angle of the surface of said recording medium starts to decrease; and (a-2) selectively heating an area on the surface of said recording medium, said area corresponding to each of the dots which form the latent image, so that said area having the receding contact angle whose value corresponds to a temperature of said area heated by said step (a-2) becomes each of the dots which make up the latent image; and (b) developing the latent image obtained in said step (a) by a liquid recording agent relative to which said recording medium is moved in a moving direction, wherein each of the hexagonal shaped dots which make up the latent image obtained in step (a) becomes narrower in a direction opposite to the moving direction in a portion close to the end of each of the dots.

* * * * *

UNITED STATES PATENT AND TRADEMARK OFFICE

CERTIFICATE OF CORRECTION

PATENT NO. : 5,436,642

DATED : July 25, 1995

INVENTOR(S) : Akira OYAMAGUCHI, et al.

It is certified that error appears in the above-indentified patent and that said Letters Patent is hereby corrected as shown below:

On the title page, Item [54] and Column 1, Lines 2-3, the title should read:

--RECORDING PROCESS FOR FORMING IMAGE ON NOVEL RECORDING MEDIUM--

On the title page, Item [*], the Terminal Disclaimer Date should read:

--Aug. 2, 2011--

Signed and Sealed this

Thirty-first Day of October 1995

*Attest:*

*Attesting Officer*

Bruce Lehman

BRUCE LEHMAN

*Commissioner of Patents and Trademarks*